US007281713B2

(12) United States Patent
Marksberry

(10) Patent No.: US 7,281,713 B2
(45) Date of Patent: Oct. 16, 2007

(54) DICE AND CARD GAME AND METHOD OF PLAYING

(75) Inventor: Randal Kieth Marksberry, 465 Salem Rd., Williamstown, KY (US) 41097

(73) Assignee: Randal Kieth Marksberry, Williamstown, KY (US)

( * ) Notice: Subject to any disclaimer, the term of this patent is extended or adjusted under 35 U.S.C. 154(b) by 121 days.

(21) Appl. No.: 10/971,633

(22) Filed: Oct. 22, 2004

(65) Prior Publication Data

US 2006/0087075 A1 Apr. 27, 2006

(51) Int. Cl.
*A63F 3/00* (2006.01)

(52) U.S. Cl. ..... 273/288; 273/236

(58) Field of Classification Search ..... 273/146, 273/236, 288
See application file for complete search history.

(56) References Cited

U.S. PATENT DOCUMENTS

| | | | | |
|---|---|---|---|---|
| 3,913,919 | A * | 10/1975 | Carpenter | 273/274 |
| 4,461,483 | A | 7/1984 | Kopp | |
| 5,868,391 | A | 2/1999 | Abood | |
| 7,017,908 | B1 * | 3/2006 | Tan et al. | 273/292 |

* cited by examiner

*Primary Examiner*—Vishu K. Mendiratta

(57) ABSTRACT

A combined adult dice and card party game, which directs and leads the players into a variety of tasks throughout the entire game using colored numbered cards, colored numbered dice, one larger die with different symbols, specialty cards and set of rules.

5 Claims, 4 Drawing Sheets

Drawings:
Larger specialized multiple chance device
(THE BIG TASK DIE)
with viewable sides depicting some of theTask Symbols

Drawings:
Graphic Task Symbols for Larger Specialized Die

Drawings:
Graphic Symbols for ROLL'EM SHOW'EM deck of TASK CARDS

Drawings:
Larger specialized multiple chance device
(THE BIG TASK DIE)
with viewable sides depicting some of theTask Symbols

Drawings:
The Fake Money Design

DICE AND CARD GAME AND METHOD OF PLAYING

FIELD OF INVENTION

This invention relates to an adult dice and card game with a method of playing said game. Wherein, this particular theme is guided for adults and the concept and format can be construed and adapted to apply and fit many variations of subject matter and age limits of play.

BACKGROUND OF INVENTION

Dice and card games have been around for many years, and there are many variations. They provide entertainment, social interaction, skill, thought association and knowledge. The said game of invention provides all of the above along with a touch of romance, challenge and strategy. This game will test the resolve, character and limitations of the individuality of the players. The inventor wanted to create a game, wherein all the players are at risk at any given time, this being done so by either the results of the colored multiple chance devices, the direction of the opposing players, and or by the instructions of the cards being drawled from the specialty deck of cards, by the participating players during certain allocations of play.

The inventor also wanted to invent a game, in which there are a variety of twists and fun memorable moments. In the games in the prior art, it is the player in turn that is precisely the player affected from the outcome of his or her action of either rolling dice or activating another source of a chance device. The inventor sought to create a new concept and take it in a different direction, wherein making all of the players susceptible and vulnerable to the resulting outcome of the activated multiple chance device, not to matter which player is actually in turn.

Therefore, creating a much more exciting and enthusiastic atmosphere, wherein meaning no one is actually safe during the entire game. However, at the same time creating a game with a possible scenario, wherein a player can go unscathed the entire game, but only if he or she is lucky enough and are not effected by the results of the multiple chance devices, the opposing players, or the fate of the specialty deck of task cards.

OBJECTS OF THE INVENTION

It is an object of the present invention to provide a fun, challenging and rewarding atmosphere.

It is another object of the said invention to provide to the wanting public a new variety of a game, and method of playing said invention.

It is a further object of the said invention, to allow the players of the game to always be at risk, meaning that it doesn't matter which player is activating the multiple chance devices, all of the players are at risk.

It is a further object of the said invention to entice the players into testing their own limitations, fears and character, along with challenging the fears and limitations of their opposing players.

It is a further object of the said invention to promote socializing and group interaction.

It is a further object of the said invention to possibly unite individuals in a romantic exchange and environment, wherein it could possibly spark the fire of passion and long lasting unity, possibly bringing happiness to some of those who play the game.

It is a further object of the said invention to push the confidence level of the less confident players, this being due to their own lack of self-appreciation of who they are and what they look like, this game of invention may entice those who are uncomfortable with their physical appearance and to make possible positive changes or alterations to better themselves physically and mentally.

It is a further object of the said invention, which allows the owner (the actual purchaser of the game) to make and set certain allocations and requirements pertaining to the House Rules segment in the set of predetermined rules of play.

It is a further object of the said invention to have it played and experienced by as many people as possible, bringing them laughter and hopefully, enabling them to forget about their worries for a small length of time, while creating new friends and learning more about their old ones.

SUMMARY OF THE INVENTION

According to the present invention, this is a game of invention and method of play, in which it involves a three phases series cycle of play actions, which is done in a repetitious cycle of order throughout the entire game.

In Phase 1, the player in turn is to activate all of the colored multiple chance devices together at the same time. The resulting numbers that are appearing in play on the activated colored multiple chance devices, will determined which effected or participating player or players are to play in the next particular second phase of the game to follow. This being accomplished by the players who are holding the colored numbered cards, wherein matching and coinciding with the resulting numbers appearing in play on the activated colored multiple chance devices, these players who are holding the matching colored numbered cards, are the only effected and participating players which are to take part in the phase 2 of play action which follows, of the three phase series of play actions. (These colored numbered cards are to be selected by the individual players in the setup steps before the game starts, in accordance to the set of pre-determined rules of play).

In Phase 2, the effected participating player or players, must now activate the larger specialized multiple chance device, if only one player is in play, then he or she activates the larger specialized multiple chance device by himself or herself, if two or more players are in the play, then they must now quickly decide between them, which one of those two or more players in the effected participating group, will be the one and only player who will activate the larger specialized multiple chance device.

Once that player has been decided upon, he or she then activates the larger specialized multiple chance device only once, and whichever symbolic task appears in play on the said chance device, then all of the participating players in that particular play, must then heed to and comply with the specific task given, or be ejected out of the game, (unless he or she happens to be holding a pass card).

The larger specialized multiple chance device is an object in the game, wherein it has the specialized graphic symbols depicted upon it. These symbols are what direct the effected participating players, as to what act or task he or she will have to perform or comply with, according to the predetermined set rules of play.

In Phase 3, the effected participating players in this particular play, must now heed to and complete the performance or action, of the given task upon them or be ejected out of the game. After all of the said players in play, have each either complied to and performed the given task upon them to satisfaction, or he or she has decided not do so and eject themselves out of the game, and then placing their remaining money into the pot for the winner in the end. After all the players have satisfied their own action for the task given in the play, the colored multiple chance devices are to be given to the next player in turn in the clockwise order, wherein that player activates the colored multiple chance devices and the three phase series cycle of play starts all over again. This three phase series of play is to be done in a repetitious manner throughout the entire game, until there is a winner in the end.

DETAILED DESCRIPTION OF THE PREFERRED EMBODIMENT

Figure 1A:
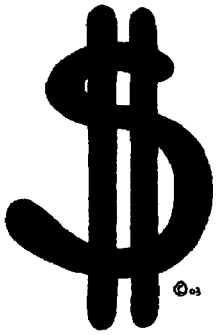
FIG. 1A is the MONEY Task Symbol, meaning when the effected participating player in play rolls this upward on the larger specialized chance device, he or she must then ante a dividend into the pot.
Figure 2A:
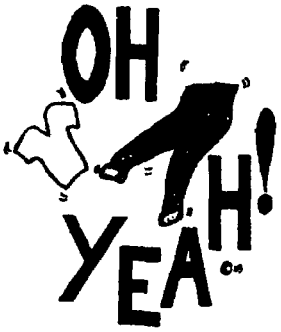
FIG. 2A is the OH YEAH Task Symbol, meaning that when a player or players acquire this Task Symbol, he or she must remove an article of clothing.
Figure 3A:
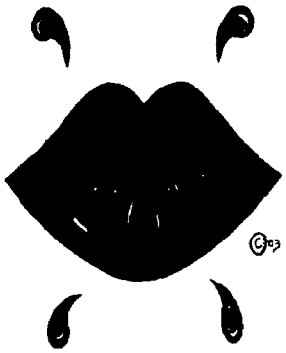
FIG. 3A is the KISS Task Symbol, meaning that if one player in the participating play, has acquired this symbol, he or she must choose an opposing player in the game to kiss. If two or more players are in this particular play and this symbol comes up on them, then they must all kiss each other.

The invention of dice and card game, wherein the players are to read and understand the pre-determined set of rules, setting and discussing the Option (an option of speeding up play, pertaining to an appropriate amount of players), House Rules segment of said pre-determined set of rules and following the steps of game set-up before the actual game begins. The steps of game set-up in preparing for the game consist of:

1. The distribution of the phony money amongst all of the participating players, being disbursed in the amount according to the set of pre-determined rules.
2. Shuffling of the specialized deck of task cards (The ROLL'EM SHOW'EM TASK DECK), and then placing them in the center of the table for easy access for all players.
3. The two or more solid colored decks of numbed cards (one deck blue matching a blue die, and the other deck white matching a white die, each deck having the numerals one thru six, coinciding with the six sides of the dice) are to be shuffled and placed facing the numerals downward and scattered on the table.
4. The players then roll all of the solid colored multiple chance devices one time each, (a blue die, and a white die), the player with the grandest total, he or she is the first player to start the selection process of the colored numbered cards, as well as to be the first player to start the actual game.
5. The player who selects his or her first colored numbered card from the two colored decks (which have been shuffled and are facing numbers downward on the table), selects only one card at a time, wherein the player who is first to select can select only a single card from any one of the colors of the colored numbered card decks lying face down scattered on the table, of his or her choice. The next player in turn in the clockwise order from the first player to drawl, is now to also select a single colored numbered card. However, this player must select from a different colored deck, differentiating in color from the first player who selected. The numbered cards from that point on, are to be selected in a clockwise order one player at a time and only one card at a time, with each player must having to alternate colors at each of his or hers selections.

After the players have selected the appropriate amount of colored numbered cards each accordingly to the number of players chart, they then place them facing numeral indicators upward, lying the colored numbered cards, in front of them for easy reference throughout the entire game.

EXAMPLE

There are two colored number card decks, one is White and one is Blue. The first player chooses to select from the White colored numbered card. The second player must select his or her choice from the Blue colored numbered cards, the third player in turn must then select from the White deck, and so on alternating colors until all of the players have the appropriate amount of colored numbered cards each, in a mixed combination of colors, according to the Number of Players Chart in the set of pre-determined set of rules.

The amount of colored numbered cards, that each player is to acquire, is determined by the amount of players in the game and if they happen to choose the faster option of play. After the players have accordingly selected the proper amount of colored numbered cards each, then each player places his or her own colored numbered cards on the table in front of them with the numbers facing upwards (the colored numbered cards stay in front of the players facing numerals upwards the entire game). This action lets the players in the game know who is holding which colored numbered cards, and also helps the players keep track as to what players are in the upcoming Task Plays. After all of the set up has been completed, we are now ready to start the actual game.

Phase 1 THE ROLL; the player who was determined to go first in the pre-game setup, rolls both of the colored multiple chance devices the Blue die and the White die together at the same time only once. The player or players who are in possession of the colored numbered cards, which are matching in color and numbers coinciding with the revealing numbers in play on the Blue die and the White die, these players are the only effected and participating players to proceed on to the next phase of play.

Figure 1C:
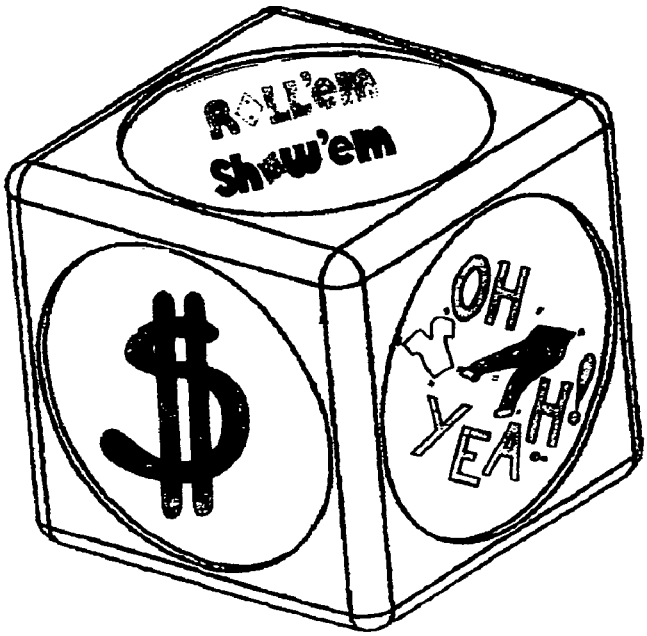
FIG. 1C this is a drawing showing what the larger specialized chance device will look like with the Symbolic Task Symbols depicted on all viewable sides.
Figure 1D:
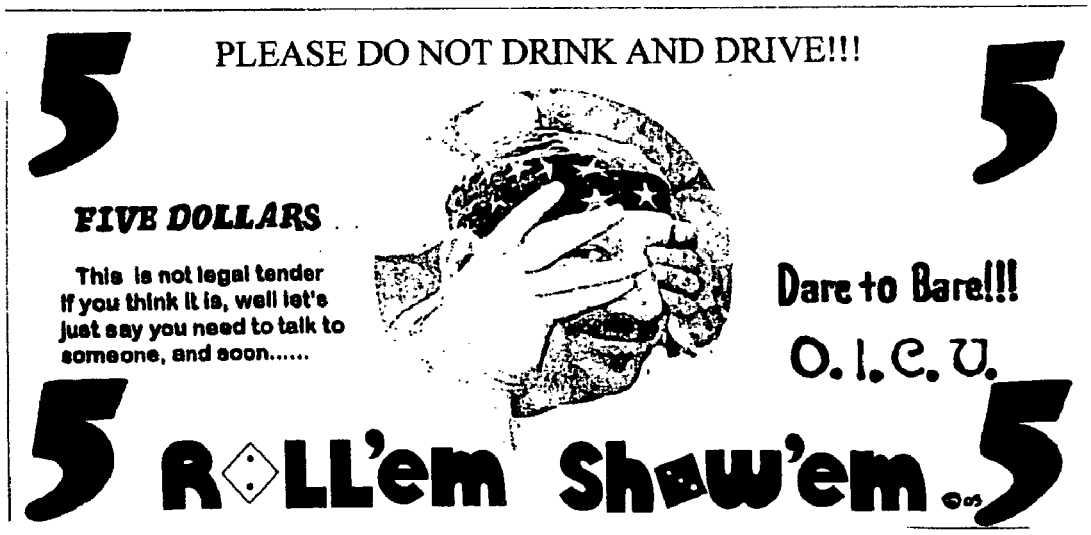
FIG. 1D the design of the fake money to be used in the game.

Phase 2 TASK PLAY; The TASK PLAY is when the effected and participating player or players involved from the Phase 1, are now instructed to roll the larger specialized die, being the so-called BIG TASK DIE. The BIG TASK DIE is the larger specialized multiple chance device, (it being a larger die manufactured out of a blown plastic injection mold, and having the six differentiating Task Symbols depicted on each one of it's sides. Detailed better in (FIGS. 1A-6A) and (FIG. 1C).

Figure 12B:
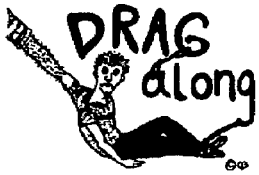
FIG. 12B the DRAG ALONG a player card, this card being held by a player from a previous drawing will enable that player later in the game, to be able to choose one opposing player, to have to go with he or she into a Task Play.

The Task Symbols that are depicted on the BIG TASK DIE are what direct and define just what Tasks the players are going to have to comply with during that particular phase and segment of the game. If there is only one player in a Task Play, then he or she rolls the BIG TASK DIE one time, and which ever Task comes upward, then that player must comply with it by himself or herself However, if there are two or more players in a Task Play, then the two or more participating players must quickly decide between them, who will be the one player to roll the BIG TASK DIE, only one time for the group. Whichever Task rolls up, all of the effected participating players in that Task Play, have to perform the same exact Task. If any player refuses to perform any given Task at anytime, with out the aid of a PASS CARD, (FIG. 7B) then that player is immediately to be ejected out of the game, and his or her remaining money is to go into the pot for the winner at the end of the game. (There is generally only a maximum of two players that can go into a given Task Play, this being in relation to having only the two matching colored numbered card decks coinciding with the White die and the Blue die, however there is a Task Card called the Drag-along Task Card (FIG. 12B) which is a strategy card, and it can enable a player to drag another opposing player into a given Task play, making it possible to have more than two players at any given Task Play). Please let it be considered that there can be a multiple amount of colored dice, and colored numbered card decks to coincide, enabling even more players to be in a Task Play at any one given time.

Phase 3 CONQUERING THE TASK; this is simply the final stage of action in which all of the participating players have either performed and completed the Task given upon them, or they have decided not to comply to the Task, and have been ejected out of the game. This is the so-called taking care of and finalizing the business at hand involving all of the participating players in play before moving on to the next player in turn to start the beginning of the three phases cycle of play (THE ROLL) all over again. When all the tasks have been successfully completed, and in satisfaction by the players, in accordance to the set of predetermined set of rules and House Rules. Then the ROLL is transferred to the next player in the clockwise order, that player is to start the three phases cycle of play all over again. This three phases series cycle of play is to be done in a repetitious manner, throughout the entire game, until there is a winner in the end. The winner in the end, being the last and only player left, with either some money left in hand, clothing left on his or her body, or being the last standing player, because of all the other players having been either ejected or quitting.

It would take an awful lot of paper and typing, wherein trying to emulate an entire game being played out and quite honestly probably impossible to do so, because of all the variations of play involved in the invention game. However, I would like to give just one example of an event of a projected possible outcome of a play, in one of these three phases cycle of repeated action of play during a game session.

EXAMPLE

The player in turn performing the ROLL, rolls both the Blue and White colored multiple chance devices together at the same time. Let's say the White #3 and the Blue #4 rolls upwards on the colored dice. The players who are holding the matching and coinciding colored numbered cards with the numbers revealed on the Blue and White dice are the only two players that are effected and now participating in the following specific TASK PLAY. These two players must now quickly decide between them, which one of them will roll the BIG TASK DIE, for the both of them only one time.

Whichever, Task rolls upward that is the Task that both of these participating players will have to perform.

Figure 4A:
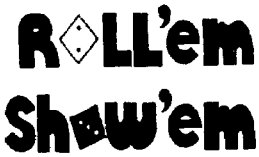
FIG. 4A is the ROLL'EM SHOW'EM Task Symbol, this symbol represents the specialized deck of cards, which is represented by the same matching logo or design on the backs of them. This means that when a participating player in play acquires this symbol, he or she must pick a card from the top of the deck of the specialized cards, which are matching and corresponding with this symbol.
Figure 5A:
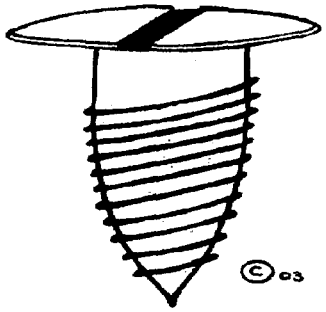
FIG. 5A is the SCREW Task Symbol, this means that when a player acquires this symbol, he or she can pick any one other opposing player and command a desired task for the opposing player to perform, (other than the SCREW).
Figure 6A:
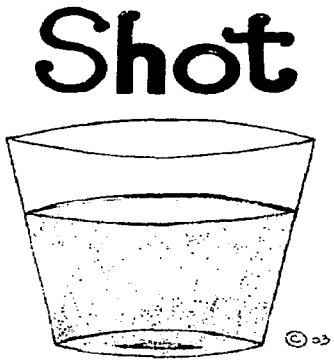
FIG. 6A is the SHOT Task Symbol, when a player acquires this symbol he or she must take a drink of his or her own choice of beverage.
Figure 1B:
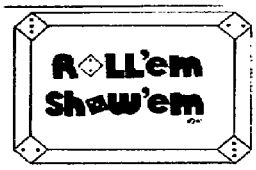
FIG. 1B this is the design for the back of the specialized task deck of cards. These being the cards the players will draw from when acquiring this matching symbol on the larger specialized chance device.
Figure 2B:
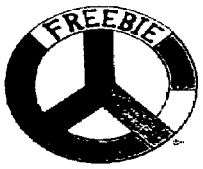
FIG. 2B this is the FREEBIE card, it enables a player who draws it to get off the hook, at that instant moment, meaning that the player will not have to perform any task, and the game resumes to the next player in turn.
Figure 3B:
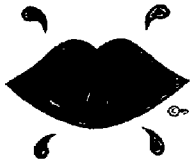
FIG. 3B this is the KISS card, if just one player acquires this card, he or she can choose any two opposing players, in which to have the two chosen to kiss one another. If there is two or more players in the play, then when drawing this card those two or more players must kiss each other.
Figure 4B:
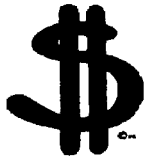
FIG. 4B the MONEY card, this card enables the player who drew it to be able to pick any one opposing player in the game, the opposing player chosen then has to ante a dividend into the pot.
Figure 5B:
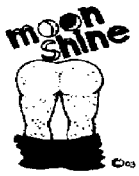
FIG. 5B the MOON SHINE card, if this card happens to be acquired by a man, then he must show his buns (bare skin bottom) to the crowd of players for a specified amount of time, (determined by the HOUSE RULES). If a woman should happen to draw this card, she can then pick any male opposing player in the game and command him to perform the task.
Figure 6B:
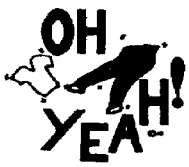
FIG. 6B the OH YEAH card, will enable the player drawing this card the ability to be able to choose one of all opposing players in the game to command the task, that he or she remove an article of clothing.
Figure 7B:
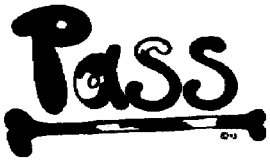
FIG. 7B the PASS card, this card is to be kept by the player who draws it, until there is a task that he or she is uncomfortable in performing, and then he or she can use this pass card to get out it, but it is only good for one time.
Figure 8B:
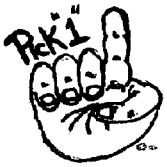
FIG. 8B the PICK ONE card, this cards enables the player who drew it to pick any one opposing player in the game, that player chosen must then immediately pick a card from the deck and comply to the given task, or be ejected out of the game.
Figure 9B:
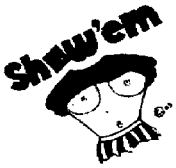
FIG. 9B the SHOWE'EM card, if a female draws this card, she must reveal her breasts for a specified amount of time (determined by House Rules), if a man draws this card, he can instruct any one opposing female player to do the task, if she refuses she is ejected out of the game.
Figure 10B:
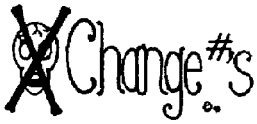
FIG. 10B the EXCHANGE #'S card, when a player draws this card, he or she has the option of exchanging his or her colored numbered cards, with either an opposing player, or switching with the discarded cards, if there is any available, however the player must perform one of the two options.
Figure 11B:
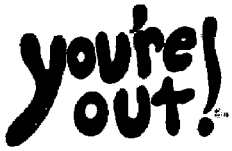
FIG. 11B the YOUR OUT! Card, this means that when a player draws this card, he or she is automatically out of the game.

Let's say these players decide between them that White #3 will be the one rolling the BIG TASK DIE (FIG. 1C), he does so, and the SCREW SYMBOL (FIG. 5A) rolls upward. This Task Symbol allows each of the two players in this specific Task Play, White #3 and Blue #4 to each be enabled to select any one other opposing player in the game, and then be able to command of the opposing players selected, that they comply with a task of White #3 and Blue # 4's choice, if the opposing player's refuse to comply to the task chosen for them, then they are ejected out of the game. White#3 and Blue #4 can select any Task on the BIG TASK DIE (FIG. 1C), except for the SCREW TASK SYMBOL (FIG. 5A). They the TASKS being the MONEY TASK SYMBOL (FIG. 1A), OH YEAH TASK SYMBOL (FIG. 2A), KISS TASK SYMBOL (FIG. 3A), ROLL'EM SHOW'EM TASK SYMBOL (FIG. 4A), or SHOT TASK SYMBOL (FIG. 6A). Let's say that player Blue #4 selects the player holding the #6 White colored numbered card, wherein giving a command and having that player perform a Roll'em Show'em Task. Wherein, #6 White now has to draw a card from the Roll'em Show'em Task deck of specialty cards (FIG. 4A). The player holding the #6 White colored numbered card, then draws a card from the top of the deck from the Roll'em Show'em Task Deck of specialty cards, looks at it and reads it aloud then either decides to comply with the given Task or refuses to do so, and if he or she refuses to comply, is ejected out of the game. (Unless of course, #6 White can be saved by a PASS CARD which he or she is holding, or being able to buy one quickly from an opposing player (FIG. 7B). So you see in this specific example the SCREW TASK SYMBOL can be a very effective and powerful strategy tool, when a player is lucky enough to acquire it on the BIG TASK DIE. Using such a strategy maneuver wherein, a player can choose an opposing player who is perhaps either low on money, or choosing a player that will not be comfortable doing a certain Task and causing that player selected to not comply, and then be ejected out of the game, wherein furthering a players chance of winning the game.

As for the White #3 player in the said Task Play, well she picked Tom, he's the player holding the Blue #2 colored number card, she decides to give Tom a command of a task being the MONEY SYMBOL, (knowing that Tom has only one dividend left). Tom (Blue #2) must now place his only dividend in the pot, or be ejected out of the game. However, Tom is still alive in the game, because he has only his shirt and underwear left on. The player at the end of the game, with either money left in hand, clothes left on his or her body or being the only player left standing, due to all of the others either quitting or having been ejected during play, wins the pot in the middle and the game.

The invention claimed is:

1. I claim a method of playing said dice and card game comprising of:

Providing a predetermined set of printed rules;

providing one solid blue die having six different sides, each side of said die being identified with a numeral of 1 thru 6;

providing one solid white die having six different sides, each side of said die being identified with a numeral of 1 thru 6;

providing one deck of six blue numbered cards; providing one deck of six white numbered cards; providing one larger six sided black die, wherein each side of said die having differentiating graphic and symbolic task symbol drawing placed on it;

providing one specialty deck of fifty two cards;

providing a printed sum of forty eight fake five dollar bills;

(*a*) determining how many players, and referring to the number of players chart in the set of pre-determined rules, wherein, to determine how many colored numbered cards each player is to select and receive prior to the games start;

(*b*) seating players in a somewhat circular arrangement;

(*c*) shuffling the deck of fifty-two specialty cards, placing said cards in a neatly stacked deck with all faces of said cards facing downward and placing them in the center of the circular arrangement of players, so to have reachable access of said cards;

(*d*) shuffling both the blue and white six card decks together, and placing them scattered on the playing surface (table, floor) with the numbered printed faces of said cards facing downward, so that the players, aren't able to identify the number of the card when selecting the proper amount of colored numbered cards according to the number of players chart;

(*e*) having each player roll both the blue and white dies together, wherein, taking the total sum of both dies of each players roll, the player rolling the highest total is to be the first player to make a selection of the blue and white colored numbered cards facing downward and scattered on the playing surface;

(*f*) the player winning the highest roll amount, is the only player having a choice of either selecting either a blue numbered card or a white numbered card from the colored numbered cards facing downward and scattered amongst the playing surface, the second player to follow in clockwise order to select a colored numbered card must select the opposite color from the first player's selection, wherein, if the first player selects a blue card, second player in turn must make a selection from the white numbered cards, third player in turn must select one of the blue numbered cards left available, wherein, having each player alternating in color selection, until the proper amount of cards have been selected accordingly by the players, regarding the number of players chart in the set of pre-determined rules;

(*g*) after players have selected the proper amount of both blue and white colored numbered cards, they then lie their selected colored numbered cards in front of them on the playing surface, having the numbered faces of said cards facing upwards, making certain the numbers on all of the faces of said cards the players have selected are exposed, wherein, enabling all players to see each opposing player's colored numbered cards they have in their possession and also letting the player's more quickly determine which players are going to be the affected players and move onto and participate in the upcoming task plays during the games play;

(*h*) each player is to receive four fake five dollar bills;

(*i*) wherein, steps (*a*)-(*h*) are primarily the steps for pre-game setup, (*j*) the actual start and playing of said dice and card game is now ready to begin, wherein, the first player who rolled the high roll off for the selecting order of the colored numbered cards in step (*e*), said player is also the first player to start the game, (*k*) said player in turn rolls both the blue and white dies together at the same time and only once, letting them come to rest on the playing surface, whatever numbers roll facing upwards on the resting sides of the blue and white dies, these are the only specific numbers of interest affecting the players at this time, wherein, only the player/s who have the blue or white colored numbered cards, that are matching exactly with the numbers resting and facing upwards on said white and blue dies, these players are the ones to participate and move onto the next task play phase/cycle of the game being called the task play;

(*l*) the task play, wherein the player/s in possession of the matching colored numbered cards, that are matching the numbers on the resting faces of the blue and white dies of a players roll, are to progress and participate in a task play, wherein, when there are two players in said task play and each player is holding one matching colored numbered card either the blue numbered card or the white numbered card, the two players are to quickly decide between them which player will roll the larger six sided black die only once, wherein, this single roll of the larger six sided black die, is representing both players in said task play at hand, whichever, of the six differentiating task symbols roll resting and facing upwards on the larger six sided black die, then both participating players in said task play must then comply to and perform to satisfaction that particular task given, or be ejected out of the game;

when there is only one player holding both said colored numbered cards matching the numbers rolled facing upwards during a player's roll on the blue and white dice, then said sole player is to roll the larger six sided black die one time, and can opt to either perform the task given that is facing upwards on the larger six sided black die twice, or if said player prefers, he/she can roll the larger six sided black die a second time, and perform both tasks given, this aspect possibly enables the player a little better chance and more control to better his/her prospects in the game;

(*m*) settling up the task play, wherein, having the player/s involved in the most recent task play either complying to and performing the task given at hand, or declining to do so and being ejected out of the game and placing any remaining money of the player/s ejected from the game in the pot for the winner in the end, wherein, after having said players finish with their appropriate actions accordingly and satisfactorily, either complying to and performing the given task, or refusing to do so and being ejected from the game, the blue and white dice are then to be given to the next player in clockwise turn, wherein, said player in turn is to roll the blue and white dice together again just once, letting them come to rest wherein, starting the three phase/cycle of play (*k*)- (*l*)- (*m*) all over again to determine by said rolling of the blue and white dies, which player/s will be the next to have to participate in the upcoming task play;

(*n*) the three phase/cycle of play, wherein steps (*k*) thru (*m*) are done in order and in a repetitious manner throughout the entire game, until only one player remains and is declared being the winner according to the conditions of the pre-determined set of rules. Please be advised that the theme and subject matter of said dice and card game can be altered to accommodate any subject matter of play and winning rules as desired, wherein, also being able to alter said dice and card game to any amount of players greater to the amount of players mentioned.

2. What is claimed is a method of play, where as mention in claim 1(*a*) the number of players chart in set of pre-determined set of rules;

(*a*) 7 players or more=you can have each player choose only one colored numbered card in the alternating color selection order as described in 1(*f*) either blue or white, or choose the OPTION of play, wherein, the OPTION is only possible to use when there is an uneven amount of players being of five or greater, or an even number amount of players being greater than six;

(*b*) 6 players=each player is to select two colored numbered cards, one blue numbered card and one white colored numbered card in the color alternating selecting order as described earlier in claim 1(*f*);

(*c*) 5 players=each player is to select one white colored numbered card, and one blue colored numberd card, or you can opt to use the OPTION of play;

(*e*) 4 players=each player can select two colored numbered cards, one blue and one white colored numbered cards, or have all the colored numbered cards utilized in the game and select in the color alternating picking as described in claim 1(*f*), wherein, each player will have in possession, either two blue colored numbered cards and one white colored numbered card, or vice-versa, two white and one blue, therefore, utilizing all twelve colored numbered cards in the game, six white and the six blue;

(*f*) 3 players=You can have each player choose just two colored numbered cards, one white and one blue, or you can utilize all twelve colored numbered cards, and have each player select two blue and two white, in the color alternating selection picking order described in 1(*f*);

(*g*) 2 players=You can have both players choose from two-six colored numbered cards each in the color alternating selecting order as described in 1(*f*), depending on how fast you want the game to go, wherein, the more colored numbered cards you utilized and activate in the game, the faster the pace goes, when utilizing all twelve colored numbered cards, every roll of the blue and white dies will enable there to be a player/s involved in a task play, therefore speeding up the play of the game.

3. Where as mentioned in claim 2(*a*) the OPTION; wherein, the OPTION is a unique characteristic of the pre-determined set of game rules, this feature enables the players to hold a vote, with the majority declaring that they shall utilize all of the leftover colored numbered cards remaining that have not yet been selected, after all the players have made their initial selection of said cards according to the number of players chart in set of pre-determined rules, the OPTION action is done to utilize all twelve colored numbered cards of both white and blue six card decks amongst the players, wherein, speeding up the games play time and giving some of the players an edge having a lesser amount of colored numbered cards, the least amount of colored numbered cards you are in possession of, the less chance you have of matching the numbers rolled upwards on the blue and white dies during play, wherein diminishing your chances of having to participate in a task play and enabling the player to possibly remain in the game for a longer period of time.

4. Where as mentioned in claim 3, the OPTION, when decided by the majority of players by a vote to utilize all twelve colored numbered cards in said dice and card game, the additional selection of the remaining colored numbered cards will go as follows, wherein, once all player's have all made their first selection of either a white or blue colored numbered card in the color alternating order selection and according to the satisfaction of the number of players chart, the player's will then determine how many colored numbered cards are remaining and have a roll off to determine which players will have to select one of the additional colored numbered cards remaining, all of the players in the game will roll both the blue and white dies together, summing up the total of both dies per player's turn, wherein, having the amount of player's with the lesser amounts of the roll off equaled to the amount of remaining colored numbered cards, these are to be the players who will each have to select an additional colored numbered card from the ones remaining from the initial selection, wherein, making sure the players select an additional colored numbered card from the opposite color of the prior one they have selected, mixing up the blue and white colored numbered cards as much as possible until all twelve colored numbered cards (six blue and six white) have been selected and utilized amongst the players, prior to the games beginning, however, there is going to be a possibility that when utilizing the OPTION during a game, a player could wind up holding two cards of the same color when having to select an additional colored numbered card, this is only acceptable when there is no other way of having both cards of the opposite color and being able to divide the blue and white colored numbered cards up as much as possible amongst the players, a player can also wind up with the same colored numbered cards throughout the playing of the game, due to the outcome of play action of the numbers X-Change card in the specialty deck of fifty two cards and set of pre-determined rules, but prior to the games start the players should divide the colored numbered cards up as much as possible alternating in color selection; The Number X-Change card is illustrated and defined in the drawing pages of this application.

5. What is claimed is a method of play; wherein, inventing the three phase/cycle of repetitious play action being steps (*k*)-(*m*) of claim 1, wherein, doing so creating a unique characteristic of the said dice and card game, wherein, having only the players who happen to be holding by chance the exact matching colored numbered cards that match the numbers that have rolled facing upwards on the white and blue dies during an opposing player's roll of the colored dies, or of the exact player in turn rolling of the dies, only said players holding matching cards are affected, wherein, these players then move onto the task play, to roll another die, this being the larger six sided black die to determine which task the players will have to comply to; this three phase/cycle of play, also creates a new element of play atmosphere in said dice and card game, wherein, having every player at risk of being affected at any point of the game, and not to matter which player is at turn to actually roll the blue and white dies together; this unique characteristic not to be found in other games, wherein, in other dice and card games, it is primarily the exact sole player at turn at either rolling the dice or selecting a card from a deck, whom is exactly the sole player which is to be to be affected.

* * * * *